United States Patent [19]

Hughes

[11] Patent Number: 4,928,440

[45] Date of Patent: May 29, 1990

[54] DECONTAMINATION BOOTH

[75] Inventor: Joel J. Hughes, Wilmington, N.C.

[73] Assignee: Container Products Corp., Wilmington, N.C.

[21] Appl. No.: 31,611

[22] Filed: Mar. 30, 1987

[51] Int. Cl.[5] ..... B24C 3/00

[52] U.S. Cl. ..... 51/426; 51/425; 51/427; 51/273

[58] Field of Search ..... 51/425, 426, 427, 319, 51/273

[56] References Cited

U.S. PATENT DOCUMENTS

| | | | |
|---|---|---|---|
| 2,576,008 | 11/1951 | Gladfelter et al. | 51/427 X |
| 3,149,445 | 9/1964 | Nolan | 51/319 |
| 3,300,902 | 1/1967 | Dockery | 51/426 |
| 3,694,968 | 10/1972 | Isaacson et al. | 51/163.1 |
| 4,047,913 | 9/1977 | Okumura | 51/273 X |
| 4,300,318 | 11/1981 | Brown | 51/426 X |
| 4,432,168 | 2/1984 | Rampe | 51/163.1 |
| 4,505,077 | 3/1985 | Sheesley et al. | 51/426 X |

FOREIGN PATENT DOCUMENTS

| | | | |
|---|---|---|---|
| 2152782 | 5/1973 | Fed. Rep. of Germany | 51/426 |

*Primary Examiner*—Robert P. Olszewski

[57] ABSTRACT

A sealed cabinet-like work booth for use in removing contamination from reusable parts and tools. The front wall of the work booth provides a transparent inclined viewing window above sealed glove ports, with the interior of the work booth being accessible through pneumatic side doors. An air plenum provides an inlet for ambient air and cooperates with a filtered exhaust for maintaining a continuous current of air directed upon the interior surface of the viewing window for preserving an unobstructed view of the interior of the cabinet.

4 Claims, 6 Drawing Sheets

DECONTAMINATION BOOTH

FIELD OF THE INVENTION

This invention relates to a portable sealed decontamination booth that may be self contained, for use in abrasive-like blasting systems delivered into and maintained within the cabinet as it is used to decontaminate work pieces and assorted articles, such as tools and the like, with the cabinet being constructed and arranged to establish a continuing current of air flow over the interior surface of the viewing window, as well as about the article being worked so as to continuously clear the viewing window and the interior of the cabinet of view obstructing debris during the decontamination process.

DESCRIPTION OF THE PRIOR ART

The present invention constitutes an improvement over such analogous apparatuses as that disclosed in U.S. Pat. No. 3,300,902, dated Jan. 31, 1967, to Lerner B. Dockery; U.S. Pat. No. 3,352,063, granted Nov. 14, 1967 to A. H. Eppler; and U.S. Pat. No. 4,300,318 granted Nov. 17, 1981 to Donald J. Brown.

The interior of the booth of the Dockery device was accessible through hinged side doors, adapted to be opened exteriorly of the cabinet in such a manner that any contamination, debris or moisture thereon could drop outside the confines of the booth.

In apparatuses of the remaining type, disclosed in the above mentioned patents, the interior of the cabinet was accessible mainly by removing of the entire upper structure of the cabinet. The interior air flow paths were primarily directed upon the work being proccessed and had no direct relation to the viewing window.

The above as well as other disadvantages have been overcome by the present invention.

SUMMARY OF THE INVENTION

It is the principal object of the present invention to provide an improved decontamination booth for use in a decontaminating system that maintains the interior of the booth-like cabinet at a pressure of less then one atmosphere so that the ambient air introduced in the booth will establish a continuing current of air flow first directed upon the interior surface of the work viewing window and then throughout the cabinet so as to remove all view obstructing debris from the decontaminating operation.

Another object of the invention is to provide a decontamination booth for use with an abrading type system including means for exhausting air laden contamination and debris and filtering the same so that such decontaminates and debris will not be introduced into the surrounding atmosphere.

A further object of the invention is to provide an improved access system to the interior of the cabinet that includes vertically slidable pneumatic doors that are so arranged so as to be disposed within the collecting base of the booth whereby no debris or moisture that may collect thereon will escape into the ambient atmosphere during their opening and closing operation.

Other objects will appear and be made apparent hereinafter.

BRIEF DESCRIPTION OF THE DRAWINGS

The invention will be best understood by reference to the accompanying drawings which illustrate the preferred construction and arrangement of parts by which the objects of this invention are achieved and in which.

DESCRIPTION OF THE PREFERRED EMBODIMENT

Figure 1:
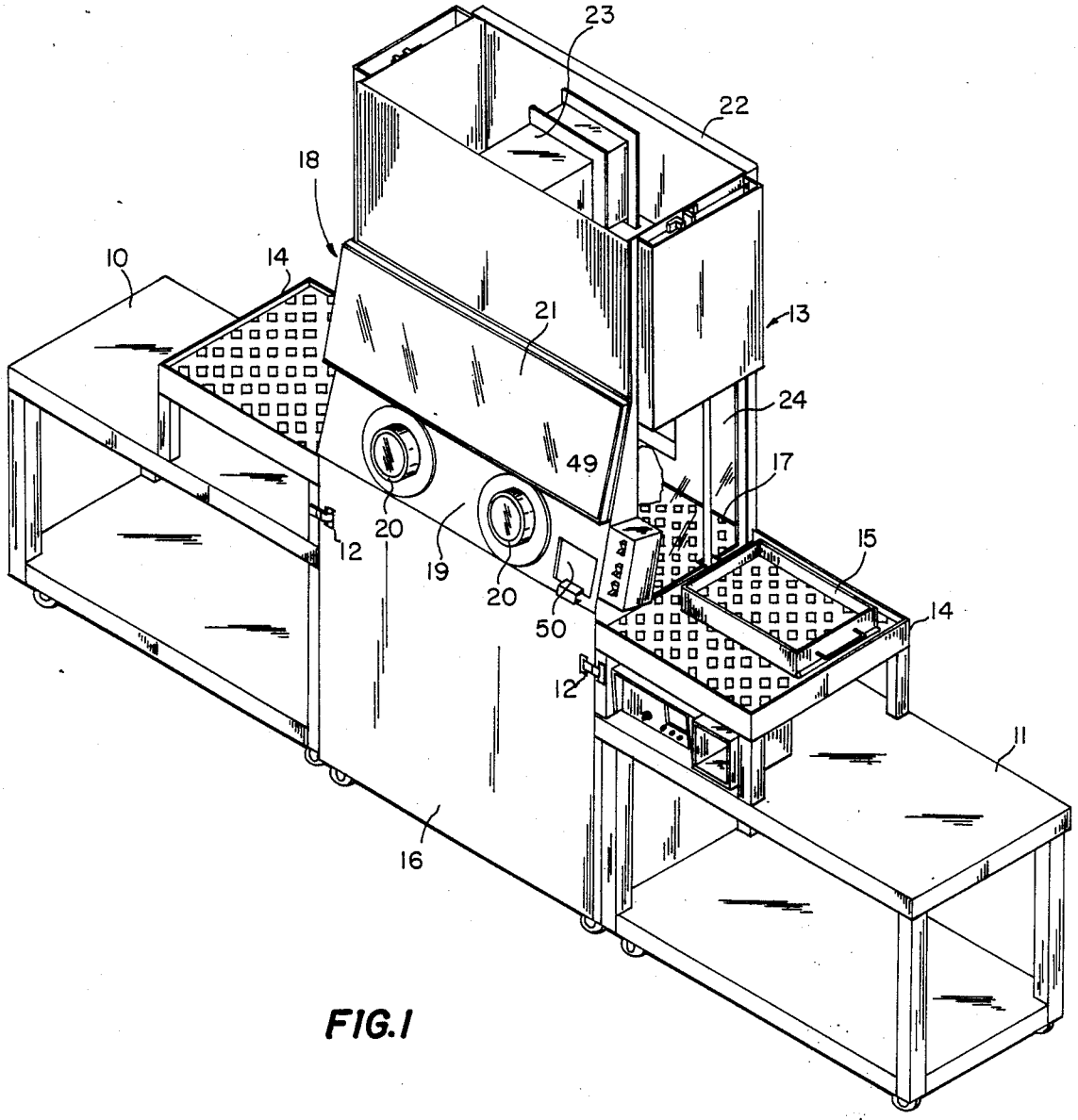
FIG. 1 is a perspective view of this invention.
Figure 2:
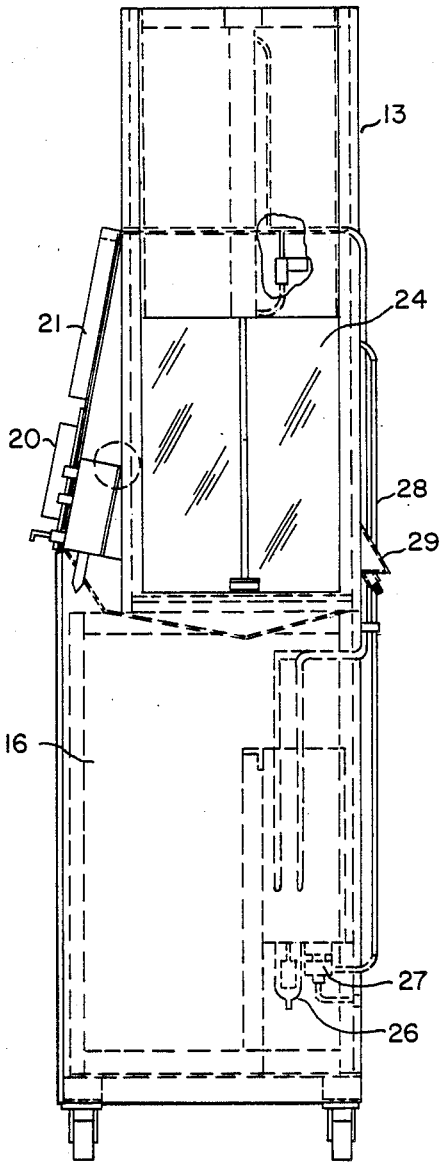
FIG. 2 is a side elevational view of the decontamination booth of this invention.

The decontamination booth is a part of a work station that as illustrated in FIG. 1 includes optional portable side tables 10 and 11 removably attached by clamp-like members 12 to either side of the booth 13. Each table provides a grating 14 that forms a base for removable roller trays 15 which are adapted to carry work pieces into and out of the booth 13.

The booth 13 provides a base 16 that houses the air evacuation system and or recovery container not shown. The top wall of the base 16 is a grating 17 that permits debris to fall through into the recovery container. Above the base 16 is the work station 18 that includes an inclined wall portion 19 which contains the glove ports 20 as well as a viewing window 21.

The top structure 22 of the booth 13 houses the air intake plenum assembly 23.

Access to the interior of the work station 18 is through a pair of side doors 24 which are adapted to the raised pneumatically.

Figure 3:
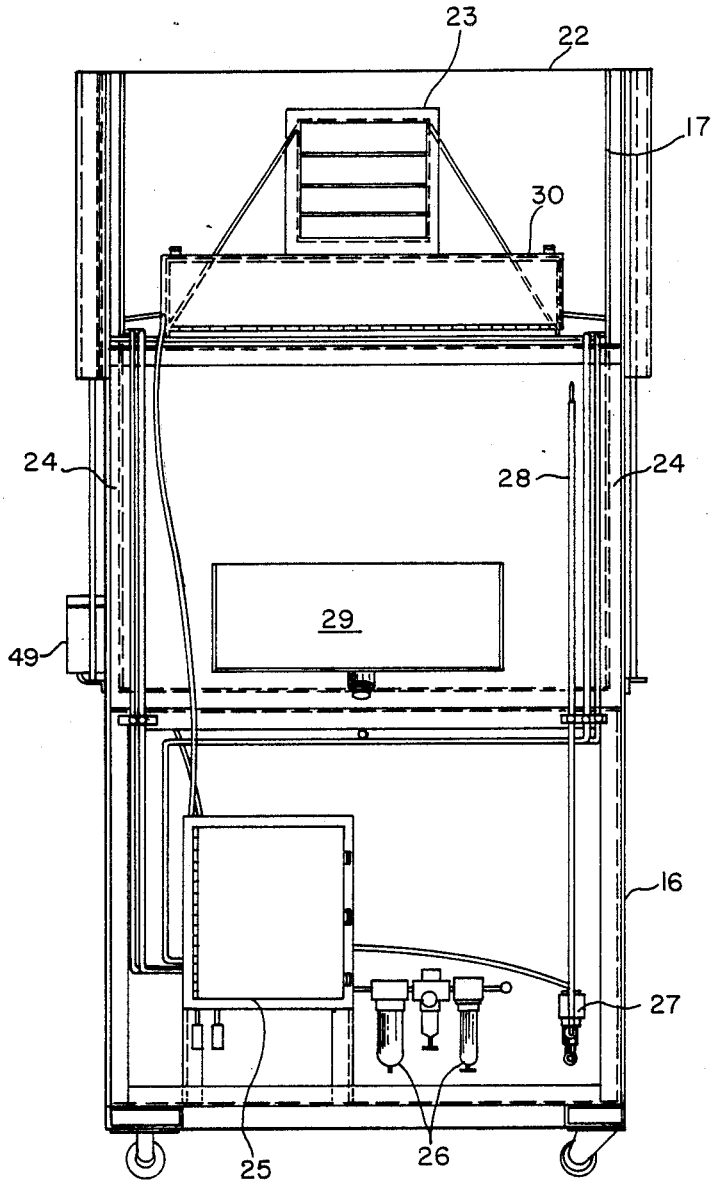
FIG. 3 is a rear elevational view of the decontamination booth of this invention.

Referring to FIG. 3 the rear wall of the base contains the electronic and pneumatic control box 25. Air regulator valves 26, as well as a steam line control valve 27, are all in communication with a supply line 28, that in turn has connection through a suitable coupling with a spray gun (not shown) positioned within the work station 18. An exhaust hood 29 protrudes from the rear wall and provides a quick connection for attachments to a vacuum system of any well known construction and operation. An interior lighting system including a light fixture 30 is positioned in the top structure 22 and is adapted to illuminate the work station 18 through a transparent sealed top wall plate 31.

Figure 4:
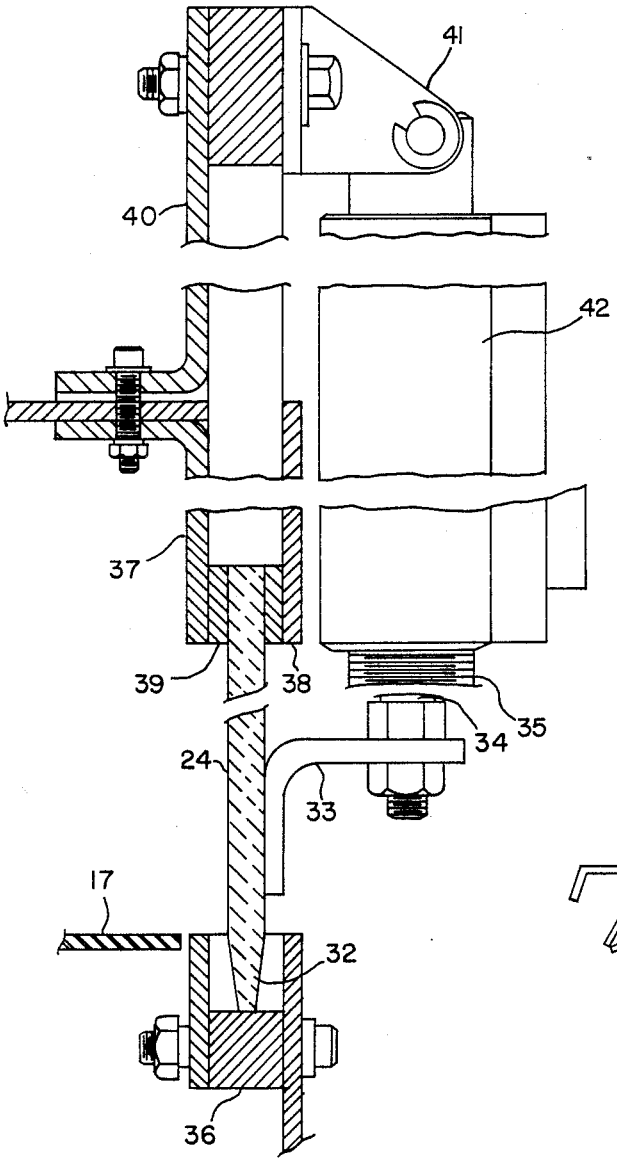
FIG. 4 is a side elevational sectional detailed view of one of the access doors of the decontamination booth.

As shown in FIG. 4 the side door 24 has connected thereto adjacent its bottom edge 32 and L shaped bracket 33. One end 34 of a pneumatic piston 35 is connected to the bracket 33 on the exterior side of the door 24.

The work station grating 17 lies in horizontal alignment with a sealing gasket 36 at the bottom plane of the closed door 24. This gasket is adapted to receive and seal the tapered bottom edge 32 of the side door 24 when in its closed position. The side walls defining the door opening are also provided with like gaskets so as to completely seal the door 24.

Mounted on the top wall of the work station 18 is a door gasket retainer bracket 37, that together with a frame structural member 38 of the booth, supports an upper sealing gasket 39 for the side door 24. A raised cowling 40 supported by the top wall of the work station provides a base for the pivot mounts 41 of the pneumatic cylinder 42 which may be enclosed within a door cowling 43 (See FIG. 3).

By this arrangement when the pneumatic cylinder 42 is actuated its movable piston 35 will raise and lower the door 24 so as to provide access to the work station 18 or to seal the same during a decontaminating operation.

Figure 5:
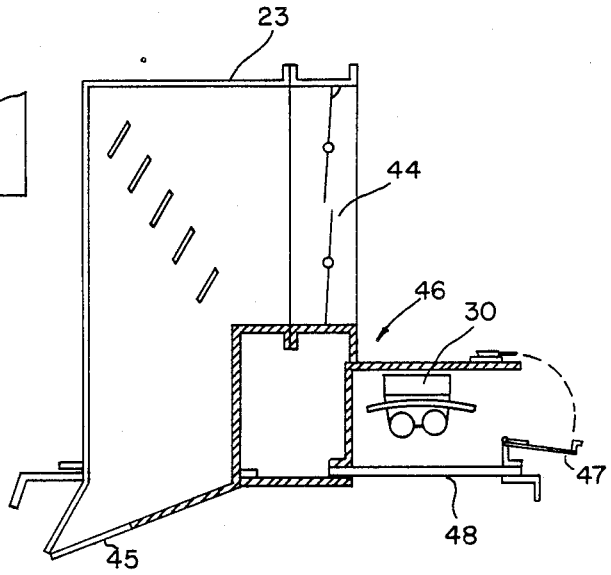
FIG. 5 is a side elevational sectional view of the air intake plenum as employed in this invention.

In FIG. 5 there is shown the arrangement of the air intake plenum 23. As such the plenum 23 includes a back draft damper 44, as well as a directional vent 45, directly over the transparent viewing window 21. Mounted to the rear of the plenum 23 is the light assembly 46. This light assembly 46 provides an access door 47 to the double light fixture 30 which is positioned above a transparent lens 48.

A suitable electrical control panel 49 is carried by the booth front wall adjacent to the glove ports 20.

Also formed in the inclined wall 19 is a manually operated sealed access door 50. After a decontaminating operation a measuring instrument maybe protruded through the access door opening into the interior of the cabinet to ascertain the presence of any excess objectionable conditions such as radiation and the like.

Figure 6:
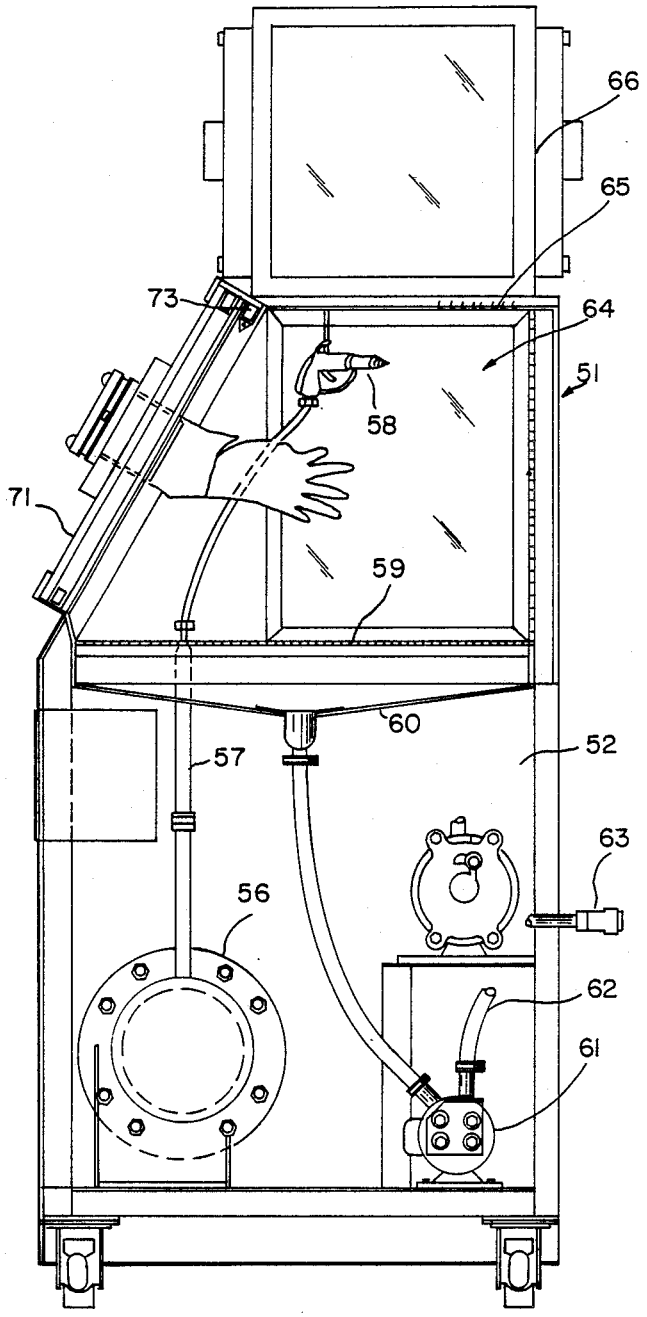
FIG. 6 is a side elevational view of a modified self contained unit of this invention.

Referring to FIG. 6 there is illustrated a portable self contained decontamination booth 51. The self contained unit provides in its base 52 a service water inlet 53 which through a filter unit 54 (see FIG. 7) is in communication with a pressure pump 55. The pressure pump 55 in turn feeds the service water to a water heater 56, that in turn through a conduit 57 supplies the cleaning gun 58 with a high temperature liquid spray.

The unit 51 has a internal perforated base plate 59 that provides a work supporting surface, which in turn is positioned above a drain pan 60 having a filtered sump 61, which through a conduit 62, is in communication with a waste water drain pump 63.

Being self contained the work area 64 is provided with a louvered exhaust vent 65 formed in the ceiling of the work compartment. This vent communicates with a filter unit 66. An exhaust fan and motor 67 is located in the upper compartment 68 of unit 51 and functions to exhaust the decontaminated air through the filter 66 and out of an exhaust not shown.

Figure 7:
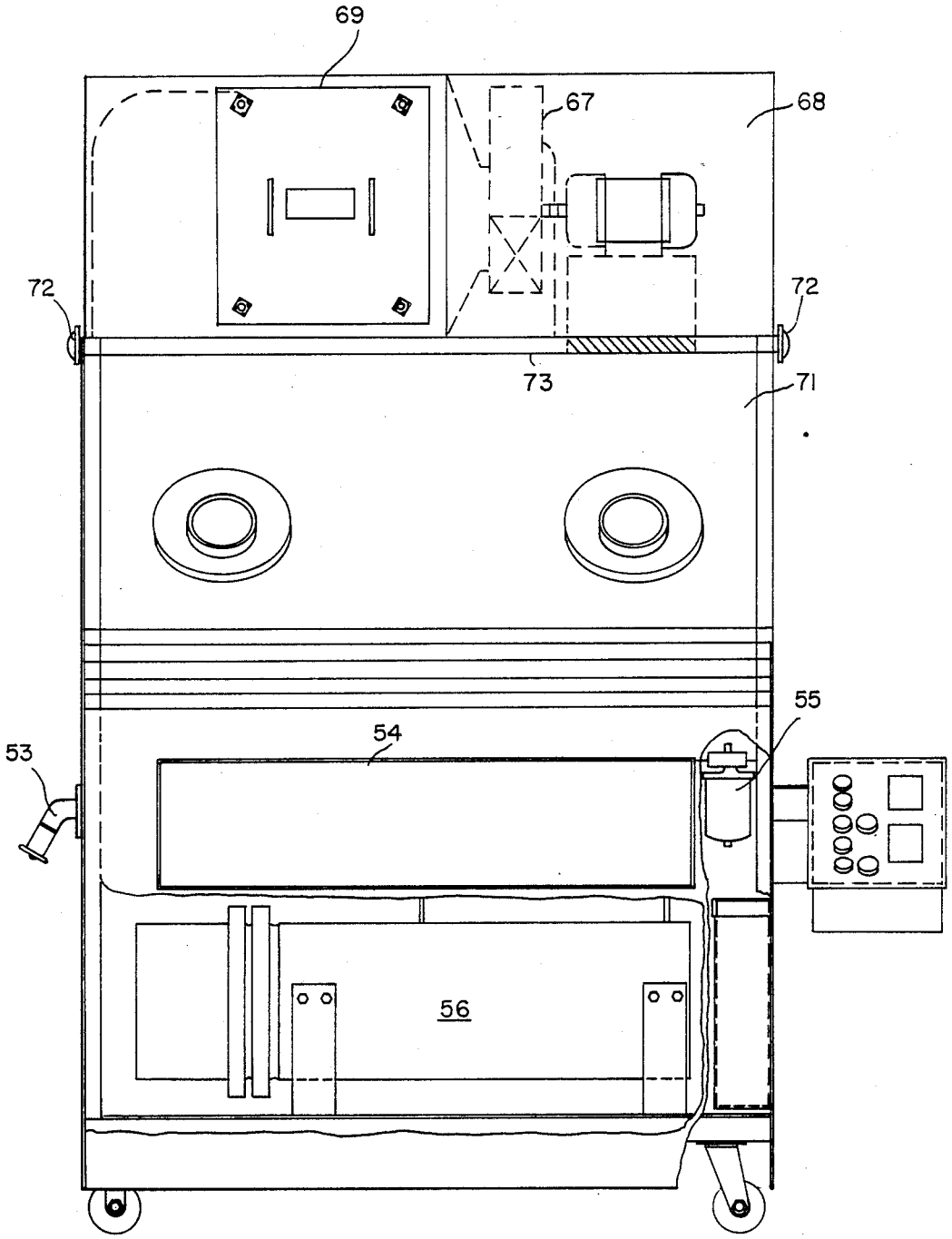
FIG. 7 is a front elevational view of the self contained decontamination booth.

The filter 66 may be replaced through an access door 69 formed in the front of the upper compartment 68 as shown in FIG. 7.

Also shown in FIG. 7 is a liquid reservoir 70 in communication with the water heater 56 and water supply pump 55 so as to maintain a constant pressure within the system.

To either side of the viewing window 71 adjacent to the top edge thereof are a pair of adjustable screened air inlets 72. These air inlets cooperate with a dispensing nozzle 73 to clean and de-fog the interior of such viewing window 71.

The modified unit 51 is provided with the same water tight vertically movable side access doors 74 of the type fully described heretofore.

From the foregoing it is apparent that there has been provided a decontamination booth which is completely atmospherically sealed by creating a negative atmosphere within the booth during its use as a decontaminating system. There has been provided pneumatically operated access doors on either side of the booth which are confined within the interior area of the booth so that when they are raised into an open position any decontamination, debris or moisture that has collected thereon will be drawn into the cabinet due to the exhausting of the air within.

While there has been illustrated and described the preferred form of construction for carrying this invention into effect, this is capable of variation and modification without departing from the spirit of the invention, therefore, there is no wish to be limited to the precise details of construction as set forth, thus making available such variations and modifications as come within the scope of the appended claims.

Having thus described the invention what is claimed and new as is desired to protect by Letters Patent is:

1. A decontamination booth including an atmospherically sealed cabinet having a source of vacuum connected thereto for applying a negative pressure in a work area within the cabinet and a steam/abrasive application gun within the work area, comprising:

(a) a cabinet having a base for housing a decontamination refuse container, (b) a work area within said cabinet having a work piece supporting grate separating it from said base, (c) an inclined viewing window for said work area including work glove ports, (d) a air intake plenum including a means for directing a current of air over the inclined interior surface of said viewing window, (e) a pair of access doors for said work area on each side wall of said cabinet, (f) pneumatic cylinders positioned exteriorly of said cabinet and above the side door openings and having their movable pistons connected to the outside surface of each of said doors for moving the same through a vertical plane within the confines of said work area and above said work piece supporting grate into an open or closed position, and (g) stationary door edge receiving gaskets sealing the periphery of said access doors against the ambient atmosphere when in a closed position.

2. A decontamination booth as defined by claim 1 including means for illuminating said work area within said cabinet.

3. A decontamination booth as defined by claim 1, including means whereby said cabinet is portable.

4. A decontamination booth as defined by claim 1, including a manually operably sealed instrument door adjacent said work glove ports through which a independent measuring instrument is insertable within said work area when said access doors are in a closed position for measuring the degree of contamination within said area before opening said side doors.

* * * * *